US007594878B1

(12) United States Patent
Joannou

(10) Patent No.: US 7,594,878 B1
(45) Date of Patent: Sep. 29, 2009

(54) WHOLE BODY VIBRATOR

(76) Inventor: Constantinos Joannou, 93 Hobart Crescent, Ottawa, ON (CA) K2H 5S3

( * ) Notice: Subject to any disclaimer, the term of this patent is extended or adjusted under 35 U.S.C. 154(b) by 0 days.

(21) Appl. No.: 12/163,183

(22) Filed: Jun. 27, 2008

(51) Int. Cl.
*A63B 22/02* (2006.01)

(52) U.S. Cl. ..... 482/54; 601/89

(58) Field of Classification Search ..... 482/51, 482/54, 68, 79, 80, 142, 148, 907; D21/334, D21/419, 669, 686, 688; 601/27, 29, 30, 601/31, 51, 53, 67, 68, 69, 70, 71, 85, 89, 601/90, 91, 98, 99, 100, 115, 116, 118
See application file for complete search history.

(56) References Cited

U.S. PATENT DOCUMENTS 4,073,500 A * 2/1978 Campeau ..... 280/87.041
4,518,176 A * 5/1985 Hegedus ..... 280/229
4,943,072 A * 7/1990 Henig ..... 280/11.215
6,011,491 A * 1/2000 Goetzl ..... 340/870.3

* cited by examiner

*Primary Examiner*—Loan H Thanh
*Assistant Examiner*—Tam Nguyen
(74) *Attorney, Agent, or Firm*—Miltons LLP

(57) ABSTRACT

This invention relates to a whole body vibrator platform which is attachable to a treadmill. The treadmill belt provides the power to move the platform, translating the horizontal, linear, belt movement into vertical oscillations through one or more eccentrically mounted rollers which support the platform. A person standing on the vibrator platform experiences a vertical vibration at frequencies established by the linear velocity of the treadmill belt.

15 Claims, 7 Drawing Sheets

WHOLE BODY VIBRATOR

FIELD OF THE INVENTION

This invention relates to an accessory for a treadmill which enables the treadmill to be converted into a whole body vibrator.

BACKGROUND OF THE INVENTION

Recently, a product appeared on the market which was originally used by the Russians to rehabilitate their astronauts after being out in space for many days. This product or device is a machine that a person can stand on and it effects vibration on the whole body. The benefit of this is to loosen up joints and to improve blood and lymphatic circulation. Another claim is that by using the device, one gets the benefit of exercise without doing actual exercise. Whole body vibrator machines are relatively expensive. They cost anywhere from $4,000 to as much as $14,000 depending on the complexity of the device.

There is also a very inexpensive machine that consists only of a platform that is suspended in rubber cushions and the platform is vibrated only in a horizontal cyclical motion. This machine does not produce vibrations in a person's whole skeleton. It only vibrates the legs.

It would be desirable to provide a device which is very simple and it effects whole body vibration just like the expensive ones on the market but at a fraction of the cost. This invention has that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention, in one of its broader terms, is a mechanical device which can be attached to a treadmill where it converts the movement of the treadmill belt to an oscillating vertical motion. As such, the invention serves as a whole body vibrator. It includes a cylinder which has an eccentrically located shaft through it. The eccentric shaft extends beyond the ends of the cylinder. At the two opposite ends of the shaft there are bearings for accepting the shaft and allowing the shaft to freely rotate within, said bearings being also attached to a platform for a person to stand on. The platform is attached to the frame of the treadmill via a link, preferably a flexible bar, so as to localize the platform on the treadmill surface.

More particularly, the invention provides a whole body vibrator for attachment to a treadmill having a moving belt whereby the motion of the belt of the treadmill is converted to a vibratory motion comprising:

a) a platform on which a user may stand;

b) a roller for contacting the belt of a treadmill wherein the roller is eccentrically supported through bearings carried by said platform; and c) a linkage connecting the platform to the treadmill to localize the platform on the belt and restrict longitudinal movement of the platform with respect to the belt, whereby the advancement of the treadmill belt causes the platform to effect an oscillating motion suited to provide a user, whose feet are positioned on the platform, with a whole body vibration experience.

According to one variant of the invention the roller is carried by an axle that is eccentrically positioned with respect to the center of the roller and extending through the roller to provide protruding ends, said ends being supported by the bearings. According to another variant of the invention the roller has outer ends and eccentrically positioned shaft ends protruding from each of the respective ends of the roller to provide roller protrusions which are coupled to the platform through bearings carried by the platform.

The linkage which positions or localizes the platform on the belt is preferably longitudinally stiff but may be laterally flexible. In order to better distribute the weight of the platform and corresponding pressure on the surface of the belt and to reduce noise a resilient layer may be provided that extends over at least a portion of the surface of the roller that contacts the belt.

In order to provide a user with a display that includes a presentation corresponding to the frequency of oscillation of the platform, the whole body vibrator of the invention may include:

a) a magnetic element mounted on the roller, b) a sensor for detecting the presence of the magnetic element mounted on the platform at a position to detect the magnetic element as it rotates past the sensor, c) a display controller connected to the sensor for generating a signal based upon the rotational velocity of the roller, and d) a display connected to the display controller to receive the signal for providing an indication of the rotational velocity of the roller.

The magnetic element may either be a piece of magnetic material, such as iron, or may be a magnetized material, such as magnetized iron or other permanently magnetized substance. The sensor may be a whole sensor or, conveniently when used in conjunction with a magnetized material, a simple coil that provides a electrical pulse as the magnetic element passes by the sensor. Simple circuitry in the controller, as would be well-known to persons skilled in the art can be employed to convert this signal into a readout for the user.

The foregoing summarizes the principal features of the invention and some of its optional aspects. The invention may be further understood by the description of the preferred embodiments, in conjunction with the drawings, which now follow.

Wherever ranges of values are referenced within this specification, sub-ranges therein are intended to be included within the scope of the invention unless otherwise indicated. Where characteristics are attributed to one or another variant of the invention, unless otherwise indicated, such characteristics are intended to apply to all other variants of the invention where such characteristics are appropriate or compatible with such other variants.

DESCRIPTION OF PREFERRED EMBODIMENTS

Figure 1:
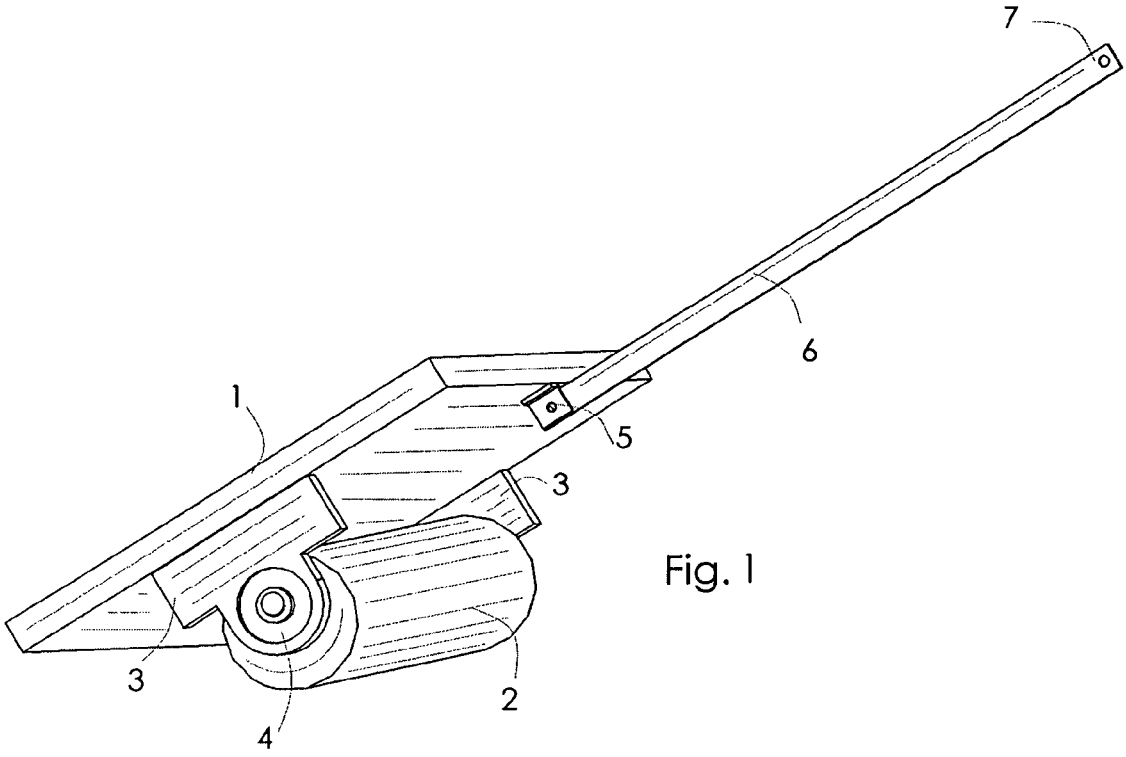
FIG. 1 shows the whole body vibrator device of the invention which is attachable to a treadmill.
Figure 3:
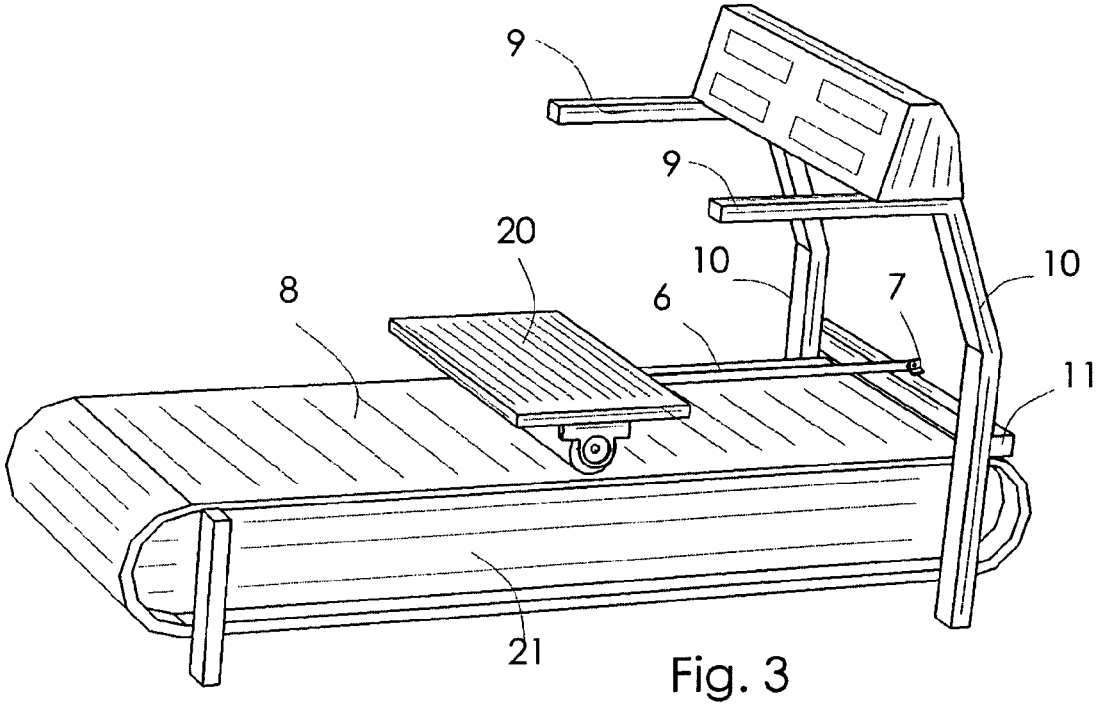
FIG. 3 shows the whole body vibrator of FIG. 1 attached to a treadmill.

The whole body vibrator 20, as best seen in FIG. 1, includes a platform 1 provided with two bearing housings 3 (shown in the form of pillow blocks) fixed to its underside face. These bearing housings 3 support an axle shaft 4 that carries a roller 2. The roller 2 is eccentrically positioned with respect to the shaft 4 and is dimensioned such that it may easily contact belt 8 of a treadmill 21 when the device 20 is positioned thereon, as seen in FIG. 3.

The roller 2 may be either fixed in its connection to the axle shaft 4, such that the two components rotate in unison, or it may be connected such that it may rotate independently from the shaft 4. In the former case, bearings are fitted into the bearing housings 3 to rotatably carry the shaft 4 and roller 2. In the latter case, the bearing surface for the vibrator 20 is provided between the roller and the shaft 4, the bearing housings 3 need not incorporate true bearings. Collectively, these provide a bearing linkage that permits the roller to rotate eccentrically.

Figure 6:
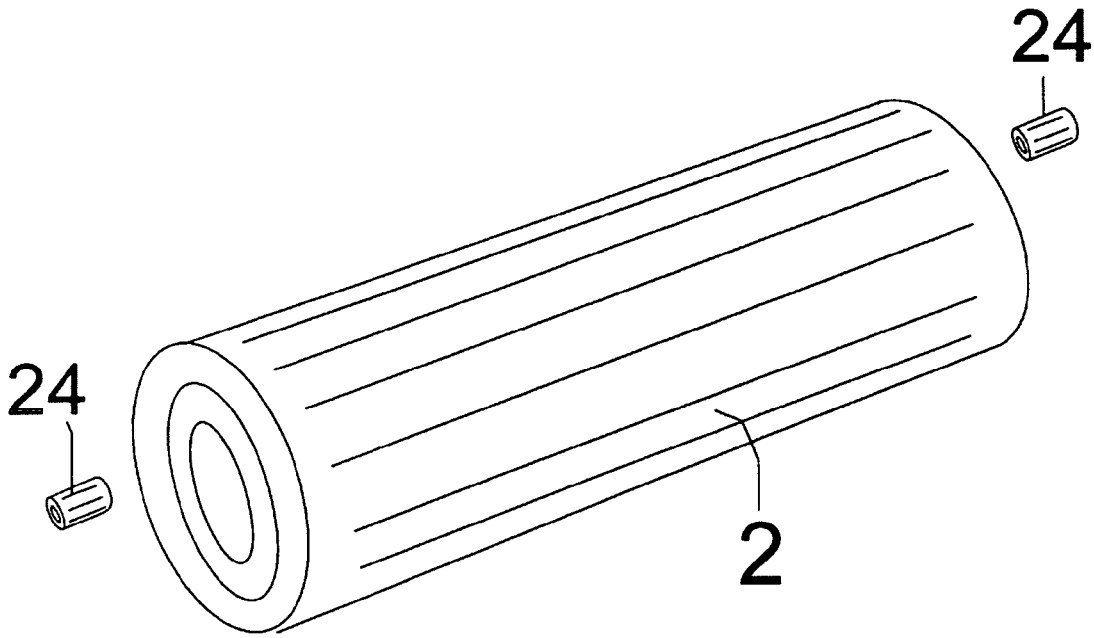
FIG. 6 shows an exploded view of the roller with two shaft ends.
Figure 7:
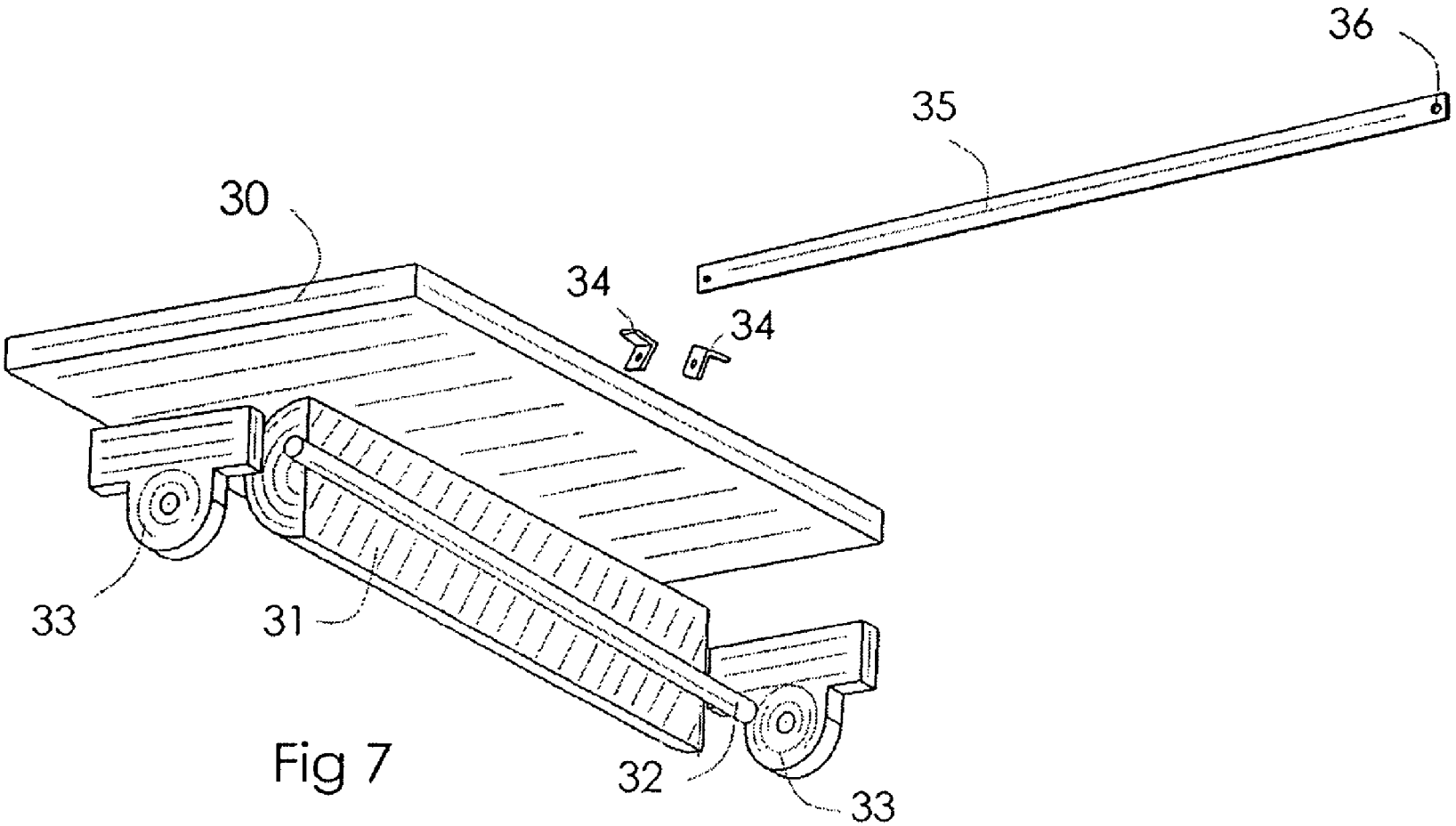
FIG. 7 shows an exploded perspective view of the underside of the whole body vibrator with the roller shown in cross-section whereby the roller rotates independently on the shaft, the bearing surface being provided between the roller and the shaft.

While the roller 2 is shown with a single shaft 4, the outer ends of the roller 2 may instead be provided with respective protruding shaft ends 24 as shown in FIG. 6 serving as axle stub ends. These shaft ends serve the same function as the single shaft 4 and are positioned in the same eccentric manner; however, they do not require extruding a channel throughout the length of the roller 2 to accommodate the shaft 4. The shaft ends 24 instead may include inner portions which are solidly embedded within the interior of the roller 2, acting as the axle stub ends. Alternatively, the roller 2 and two shaft ends 24 may be manufactured as a single, unitary component. Again, these shaft ends or stubs provide part of a bearing linkage that permits the roller to rotate eccentrically.

The system for employing the vibrator 20 further includes a linkage 22 connecting the platform 1 to the frame 10 of the treadmill 21. This linkage 22 preferably of unitary form provides longitudinal stiffness and lateral flexibility when the vibrator device 20 is positioned on the treadmill 21. Such lateral flexibility allows the roller 2 to become self-aligned with respect to the belt 8 while giving the platform freedom to rotate to a limited degree to the left and right, as well as up and down.

Figure 2:
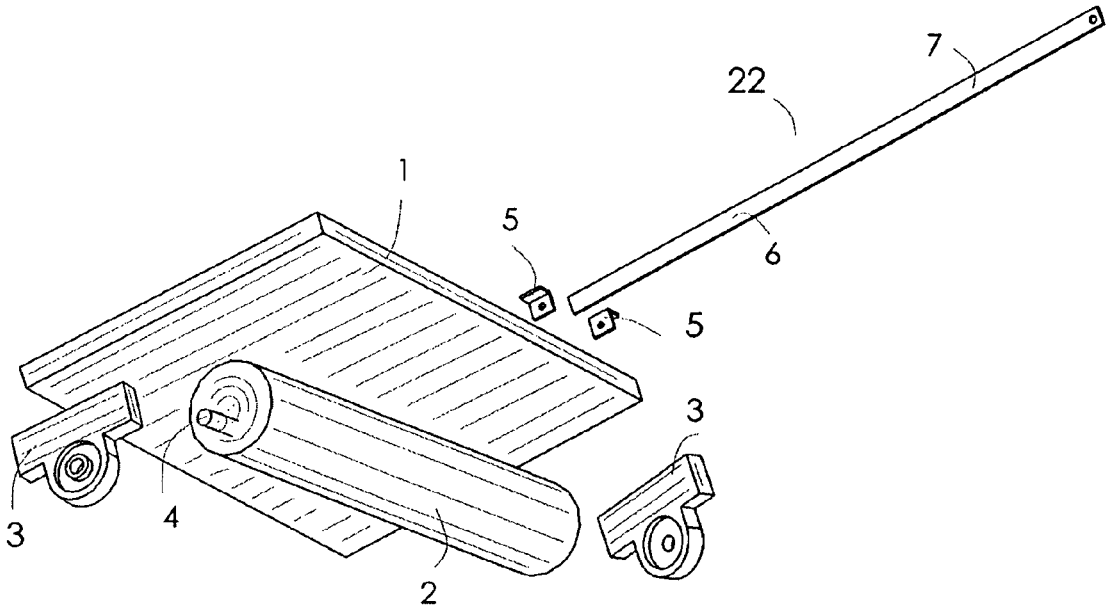
FIG. 2 is an exploded view of the whole body vibrator of FIG. 1

As shown in FIGS. 1 and 2, the linkage 22 may be in the form of a strip 6 of a flexible but stiff material such as spring steel or durable, resilient plastic connected at one end to the platform 1 via a bracket 5 and connected at its other end to the frame 10 of the treadmill 21 with a pin (not shown) passing through hole 7 and a second set of brackets. Any other appropriate connecting arrangement may be employed. If the frame 10 of a particular target treadmill does not provide a suitable fixed anchoring point to easily accommodate connection with linkage 22, the frame 10 may be coupled to the whole body vibrator through the attachment of one or more removable frame adaptation members 11 to the frame 10, as shown in FIG. 3. These frame adaptation members 11 are positioned to facilitate a more sturdy or convenient connection to the linkage 22, and their attachment to the frame 10 is effected in any such suitable fashion.

During operation, the vibrator 20 is placed in position on the belt 8 of treadmill 21. A user then climbs on top of platform 1 of the device 20 while using handles 9 to maintain their balance. The user may then activate the belt 8 of the treadmill 21 just as they would if the treadmill 21 were to be used for walking or running. The motion of the belt 8 then frictionally drives and rotates the roller 2 while any longitudinal movement of the vibrator 20 is restricted through the linkage 22.

As the roller 2 rotates under the force of belt 8, the eccentrically positioned shaft 4, moving eccentrically with respect to the roller 2, imparts vertical oscillatory motion to the platform 1. As the speed of the belt 8 is gradually increased, the frequency of the oscillations is increased and the user, standing atop the platform 1, is vibrated with increased frequency and intensity. The user may continue to use handles 9 to maintain balance and may adjust the speed of belt 8 to produce a desired frequency of vibration.

Figure 4:
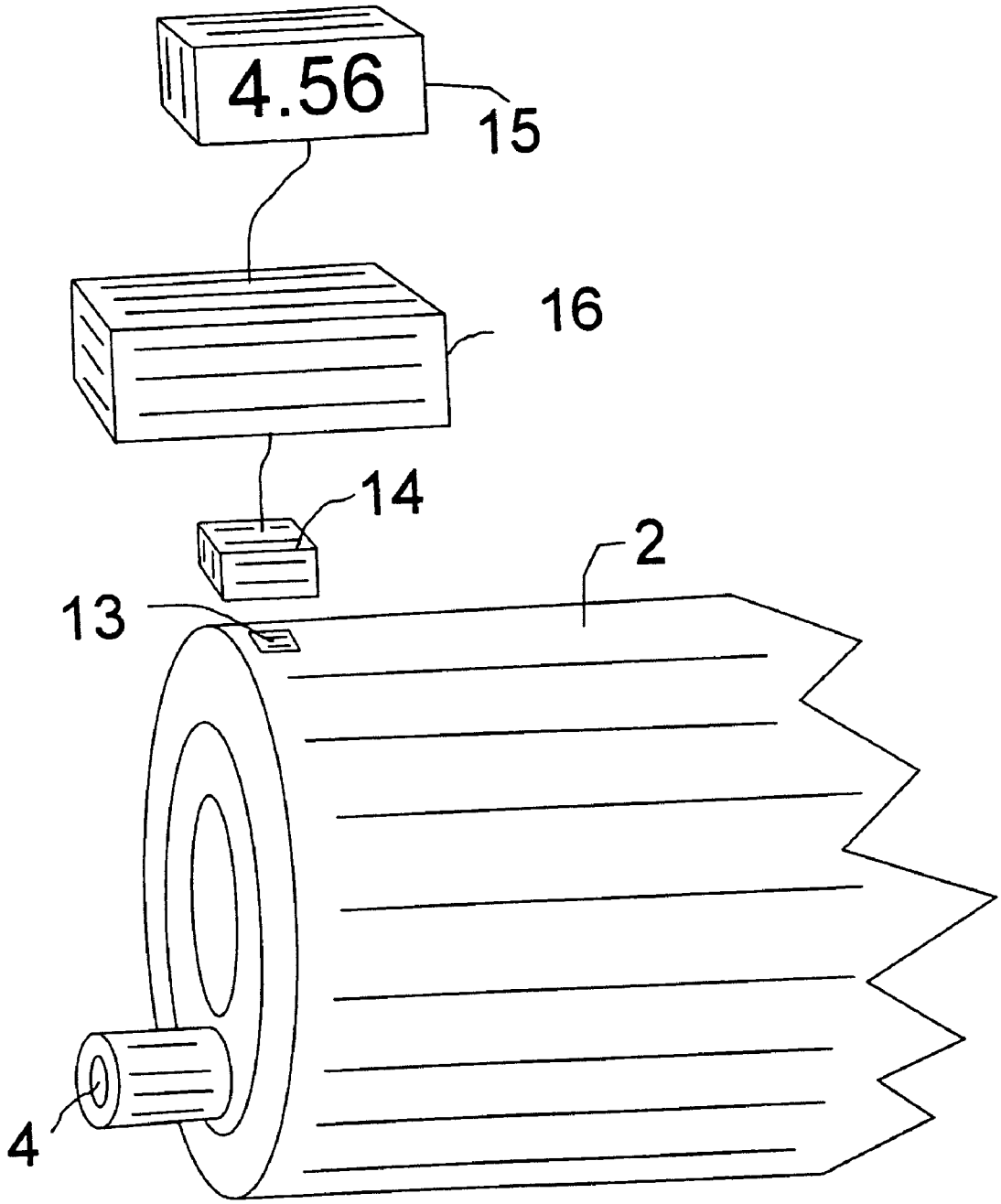
FIG. 4 shows an arrangement where a magnet attached to the roller, a sensor and a display is arranged to display relevant information to a user.

The whole body vibrator 20 may be provided with a means to display useful information such as the frequency of vibration, the rate of rotation of the roller 2, or other such information to a user. This information may be measured with the arrangement shown in FIG. 4. Here a magnet 13 fixed to the roller 2 rotates with the roller 2 and, through its magnetic flux, induces a signal in a magnetic sensor 14 positioned either on the platform 1 or bearing housing 3. Every time the roller 2 completes a rotation, the sensor 14 produces an electrical signal and delivers it to decoder 16. The decoder 16 then processes the input and provides a display 15 with a signal such that relevant information such as frequency, rotational speed, or the duration of vibration may be displayed to the user. Other optical or contact based tachometers may be alternatively used to make similar measurements and provide a signal to the display 15.

Figure 5:
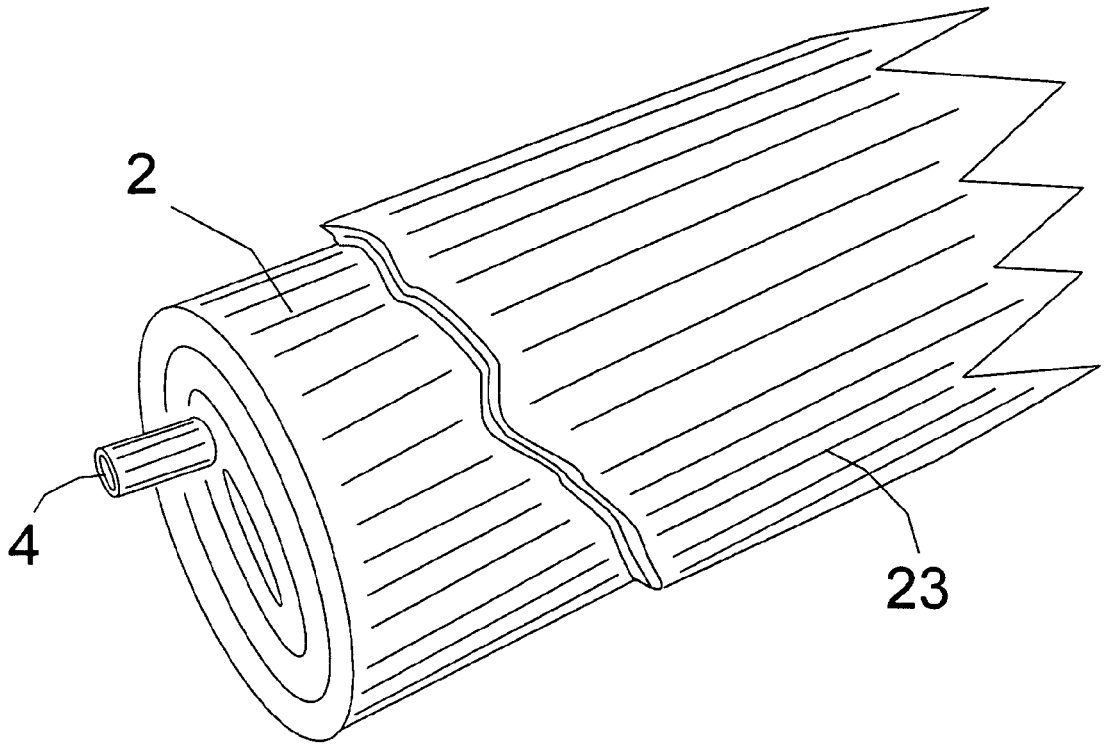
FIG. 5 shows the roller with a resilient layer over its outer surface.

Another possible modification includes cladding the roller 2 with a resilient layer, such as a sleeve 23, as shown in FIG. 5. The resilient sleeve 23 acts as a cushion to minimize noise and to distribute the load more evenly on the belt 8 and the belt substrate of the treadmill 21. It also serves to increase the friction present between the roller 2 and the belt 8 and reduce slipping while the belt 8 drives the roller 2.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The invention claimed is:

1. A whole body vibrator for attachment to a treadmill having a frame and a moving belt whereby, when the whole body vibrator is attached to the treadmill, the motion of the belt of the treadmill provides a vibratory motion, the whole body vibrator comprising:

a) a platform on which a user may stand;

b) a roller for contacting the belt of said treadmill wherein the roller is a unitary roller that comprises two outer ends and extends width-wise across the platform on its underside;

c) a shaft passing though the roller, said shaft being eccentrically located with respect to said roller and having shaft ends which extend beyond the ends of said roller;

d) rotary bearings attached to said platform and positioned at the ends of said shaft connecting said platform to said roller, and e) a forwardly extendable linkage for connecting said platform to the frame of a treadmill to localize the platform on the belt of the treadmill and restrict longitudinal movement of the platform with respect to the belt, wherein the linkage is laterally flexible whereby, when the whole body vibrator is placed on the treadmill belt with the linkage connecting the platform to the frame of the treadmill, the advancement of the treadmill belt will cause the platform to effect an oscillating motion suited to provide a user, who stands on the platform, with a whole body vibration experience.

2. A whole body vibrator as described in claim 1 in combination with a treadmill having a frame and a moving belt wherein the roller is positioned on the belt for rolling thereon upon displacement of the belt, and wherein the linkage is connected between the platform and the frame of the treadmill to restrict longitudinal movement of the platform relative to the belt.

3. A whole body vibrator as described in claim 2 wherein the roller provides the sole contact between the whole body vibrator and the treadmill belt.

4. A whole body vibrator for attachment to a treadmill having a frame and a moving belt whereby, when the whole body vibrator is attached to the treadmill, the linear motion of the belt of the treadmill provides a vibratory motion, the whole body vibrator comprising:

a) a platform on which a user may stand;

b) a roller for contacting a belt of a treadmill wherein the roller is a unitary roller that comprises two outer ends and extends width-wise across the platform on its underside, the roller being positioned beneath the platform so as to support the platform, c) a support provided at the outer ends of the roller comprising a bearing linkage that permits the roller to rotate eccentrically; and c) a forwardly extendable linkage for connecting the platform to the frame of a treadmill to localize the platform on the treadmill's belt and substantially restrict longitudinal movement of the platform relative to the belt, wherein the linkage is laterally flexible whereby, when the whole body vibrator is positioned on the belt of the treadmill and the linkage is connected to the frame of the treadmill, the advancement of the treadmill belt will cause the platform to effect an oscillating motion suited to provide a user, whose feet are positioned on the platform, with a whole body vibration.

5. A whole body vibrator as described in claim 4 wherein the bearing linkage comprises eccentrically mounted axle stub ends carried at the outer ends of the roller.

6. A whole body vibrator as described in claim 4 wherein the roller supports the platform through the respective ends of an eccentrically positioned axle shaft fixed within and extending through the length of the roller.

7. A whole body vibrator as described in claim 4 wherein the roller supports the platform through the respective ends of an eccentrically positioned axle shaft extending through the length of the roller and wherein the roller is free to rotate around the shaft.

8. A whole body vibrator as described in claim 4, 5, 6 or 7 in combination with a treadmill having a frame and a moving belt wherein the roller is positioned on the belt for rolling thereon upon displacement of the belt, and wherein the linkage is connected between the platform and the frame of the treadmill to restrict longitudinal movement of the platform relative to the belt.

9. A whole body vibrator as described in claim 8 wherein the roller provides the sole contact between the whole body vibrator and the treadmill belt.

10. A whole body vibrator as described in claim 8 wherein the linkage is a unitary, longitudinally stiff member having first and second ends, the first end being connected to the platform through a bracket located on the platform and the second end being connected to the frame of the treadmill.

11. A whole body vibrator as described in claim 8 comprising a resilient layer in the form of a sleeve extending over the portion of the surface of the roller that will contact the belt to better distribute the load arising from the weight of the user more evenly on the belt and to reduce noise.

12. A whole body vibrator as described in claim 8 comprising:

a) a magnetic element mounted on the roller, b) a sensor for detecting the presence of the magnetic element carried by the platform at a position to detect the magnetic element as it rotates past the sensor, c) a display controller connected to the sensor for generating a signal based upon the rotational velocity of the roller wherein the signal is indicative of the frequency of oscillation of the platform, and d) a display connected to the display controller to receive the signal generated by the display controller.

13. A whole body vibrator as described in claim 2 wherein the linkage is a unitary, longitudinally stiff member having first and second ends, the first end being connected to the platform through a bracket located on the platform and the second end being connected to the frame of the treadmill.

14. A whole body vibrator as described in claim 2 comprising a resilient layer in the form of a sleeve extending over the portion of the surface of the roller that will contact the belt to better distribute the load arising from the weight of the user more evenly on the belt and to reduce noise.

15. A whole body vibrator as described in claim 2 comprising:

a) a magnetic element mounted on the roller, b) a sensor for detecting the presence of the magnetic element carried by the platform at a position to detect the magnetic element as it rotates past the sensor, c) a display controller connected to the sensor for generating a signal based upon the rotational velocity of the roller wherein the signal is indicative of the frequency of oscillation of the platform, and d) a display connected to the display controller to receive the signal generated by the display controller.

* * * * *